United States Patent [19]

Samuelson

[11] Patent Number: 4,762,591

[45] **Date of Patent: * Aug. 9, 1988**

[54] APPARATUS FOR REACTING LIGNOCELLULOSIC MATERIAL WITH A GAS PHASE COMPRISING A NITROGEN OXIDE AND OXYGEN UNDER CONTROLLED GAS PRESSURE

[75] Inventor: Hans O. Samuelson, Gothenburg, Sweden

[73] Assignee: Mo och Domsjo Aktiebolag, Ornskoldsvik, Sweden

[ * ] Notice: The portion of the term of this patent subsequent to Sep. 27, 2000 has been disclaimed.

[21] Appl. No.: 21,954

[22] Filed: Mar. 5, 1987

Related U.S. Application Data

[63] Continuation of Ser. No. 719,173, Apr. 3, 1985, abandoned, which is a continuation of Ser. No. 572,282, Jan. 20, 1984, abandoned.

[30] Foreign Application Priority Data

Mar. 9, 1984 [SE] Sweden ..... 8300388

[51] Int. Cl.[4] ..... D21C 1/08; D21C 7/00

[52] U.S. Cl. ..... 162/237; 162/241; 162/242; 162/246; 422/189; 422/232

[58] Field of Search ..... 210/761, 762, 177; 162/65, 81, 18, 19, 233, 237, 238, 241, 242, 246; 422/189, 232

[56] References Cited

U.S. PATENT DOCUMENTS

| | | | |
|---|---|---|---|
| 1,643,566 | 9/1929 | Thorne | 162/65 |
| 2,932,613 | 4/1960 | Huesler | 210/761 |
| 3,525,665 | 8/1970 | Gessner | 162/65 |
| 4,076,579 | 2/1978 | Brink | 162/65 |
| 4,087,318 | 5/1978 | Samuelson | 162/65 |
| 4,283,251 | 8/1981 | Singh | 162/65 |
| 4,384,920 | 5/1983 | Markham | 162/65 |
| 4,406,735 | 9/1983 | Samuelson | 162/81 |

*Primary Examiner*—Ernest G. Therkorn

[57] ABSTRACT

Apparatus for reacting lignocellulosic material with a gas phase comprising a nitrogen oxide and oxygen under controlled gas pressure in the presence of water, for example, as a pretreatment before an alkaline delignification, comprising in combination:

(1) a first reaction chamber receiving water-containing lignocellulosic material, nitrogen oxide, and optionally oxygen containing gas;

(2) a first inlet for introducing lignocellulosic material into the first reaction chamber;

(3) a second inlet with control means for introducing nitrogen oxide into the first reaction chamber;

(4) a first outlet for withdrawing lignocellulosic material after reaction with oxide from the first reaction chamber;

(5) gas locks retaining gas pressure in the first reaction chamber at each of the first inlet outlet;

(6) a second reaction chamber in connection with the first reaction chamber via the gas lock at the outlet thereof and receiving lignocellulosic material after reaction with nitrogen oxide;

(7) a third inlet with control means for introducing oxygen into the second reaction chamber;

(8) a second outlet for withdrawing lignocellulosic material after reaction with oxygen from the second reaction chamber; and (9) a gas lock retaining gas pressure in the second reaction chamber at the second outlet;

the second reaction chamber having a volume that is at least 2.5 times and preferably at least 10 times the volume of the first reaction chamber.

9 Claims, 1 Drawing Sheet

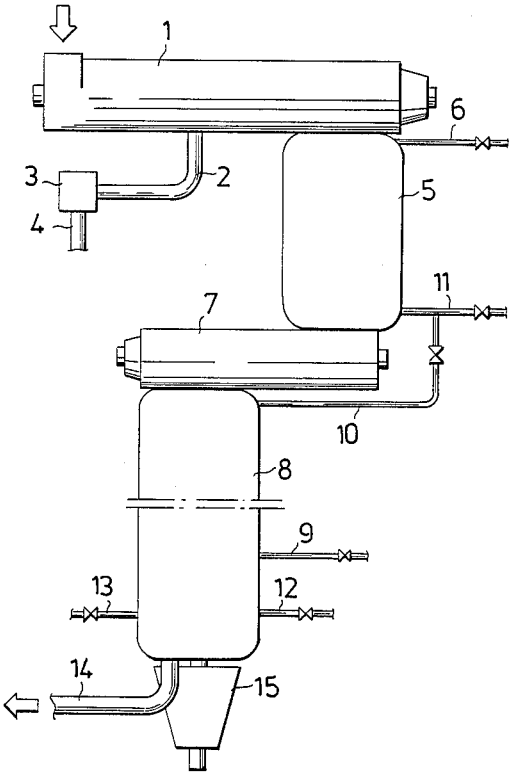
Fig. 1
Fig. 2
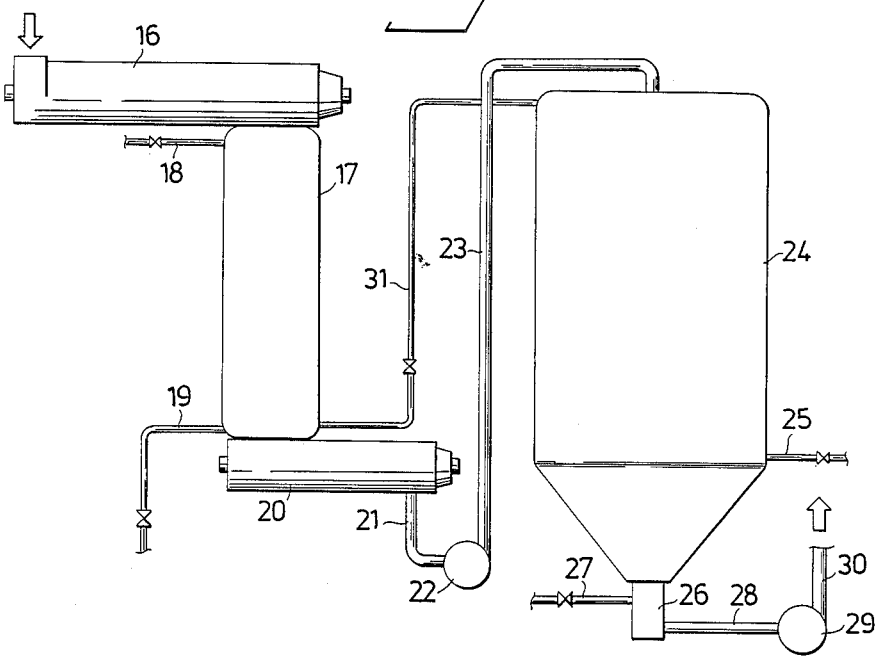

APPARATUS FOR REACTING LIGNOCELLULOSIC MATERIAL WITH A GAS PHASE COMPRISING A NITROGEN OXIDE AND OXYGEN UNDER CONTROLLED GAS PRESSURE

This is a continuation of application Ser. No. 719,173, filed Apr. 3, 1985, which in turn is a continuation of Ser. No. 572,282, filed Jan. 20, 1984, both now abandoned.

BACKGROUND OF INVENTION

It is a well known that chlorine-containing bleaching agents give rise to chlorinated aromatic substances. The major part can not be destroyed by biological purification of the sewage water. Some chlorinated compounds discharged with spent bleach liquor are bioaccumulatable and taken up by fish. Some chlorinated products have been found to be mutagens.

Consequently, disposal of chlorine-containing waste bleaching liquor from bleaching plants constitutes a very serious problem. Efforts have been made to reduce the use of free or elementary chlorine in the bleaching of cellulose pulp by use of chlorine dioxide instead. The production of chlorine dioxide requires about three times as much electrical energy per kilogram of active chlorine as elementary chlorine.

Nitrogen dioxide has been proposed as a substitute for chlorine in the bleaching delignification of cellulose pulp, and has been studied by Clarke (*Paper Trade Journal, Tappi, Sect.* 118 62 (1944)). Clarke has found that cellulose pulp can be partially delignified by treating the pulp in an aqueous suspension for from 1 to 1.5 hours at 90° C. with nitrogen dioxide, followed by extraction at 90° C. for 30 minutes, or at 50° C. for 60 minutes at a 7% pulp consistency and an alkali charge corresponding to 2% NaOH, calculated on the dry weight of the pulp. The treatment results in a severe depolymerization of the cellulose, which is reflected in a very low viscosity of the treated pulp, compared with pulp subjected to chlorination and alkali extraction.

Bourit (French patent specification No. 2,158,873) avoids depolymerization by applying a delignification process in which the pulp is treated with nitrogen dioxide at low temperature, preferably a temperature below 20° C., and for a long period of time, followed by an alkali extraction under mild conditions. The cellulose pulp is only delignified to a very small extent, however, and the method does not afford any solution to existing environmental problems.

The delignification of lignocellulosic material by treatment with nitrogen dioxide, followed by washing with water, treatment with alkali, and subsequent treatment with oxygen gas, has also been proposed in Swedish patent application No. 77 05136-5. However, this technique has not been put into commercial practice, because although enabling a high degree of delignification, the method causes a drastic lowering of the viscosity.

Another proposal which has not come into practice has been made in Swedish patent application No. 75 06646-4. This bleaching process includes the steps of (1) treating the cellulosic material with a blend of nitrogen monoxide and nitrogen dioxide with nitrogen monoxide in a molar excess, (2) washing with water, and (3) then treating with alkali, for example, in the presence of oxygen gas, under superatmospheric pressure. The nitrogen dioxide can optionally be generated in situ from nitrogen monoxide and oxygen, in which case the nitrogen monoxide is added in an excess of four times the added molar amount of oxygen. The reaction proceeds under superatmospheric pressure with respect to nitrogen monoxide; for example, 7 kp/cm$^2$ is shown in Example 1. The nitrogen oxides are removed by depressurizing, followed by evacuation. In every Example, a superatmospheric pressure is employed in the handling of the nitrogen oxides. The handling problems remain, with a great risk of injury to both the internal and external surroundings, and a high consumption of nitrogen oxides. This method also results in a considerable lowering of the viscosity, although it does enable a high degree of delignification to be obtained.

When the pretreatment with nitrogen oxide is followed by an oxygen gas bleaching stage, it is said to be suitable, subsequent to displacing or washing from the pulp pulping liquor derived from a pulping process with the use of waste liquor derived from the oxygen gas bleaching, to wash the pulp with the acid washing liquid obtained in the washing stage after the pretreatment. When the acid washing liquid is not washed from the pulp before treating the pulp with nitrogen dioxide, the pH of the liquid is reported to be 2.0, which corresponds to about 0.01 gmole nitric acid, calculated per kg of water in the pulp. The prime object of the method is to remove harmful metal compounds from the pulp.

In summary, the pretreatment of cellulose pulp with nitrogen dioxide $NO_2$ before an oxygen gas bleaching makes possible a more complete delignification and an improved oxygen gas bleaching, without deterioration in the paper-making properties of the pulp. However, relatively large quantities of nitrogen oxides and starting material (ammonia) for the manufacture of said oxides, respectively, are consumed in the process.

Brink U.S. Pat. No. 4,076,579, patented Feb. 28, 1978, delignifies particulate lignocellulosic material by nitric acid, which is formed in situ by first treating the lignocellulosic material with nitric oxide, and then reacting the nitric oxide with molecular oxygen. Brink intends to provide a higher-yield pulping process than current commercial alkaline pulping processes, one which can be conducted in an initial reaction at atmospheric pressure and relatively low temperature.

The pulping process is described in detail beginning at columns 3, line 20.

While Brink is concerned with a delignification requiring nitric acid, in contrast to an activation involving nitrogen dioxide and oxygen gas, Brink does form nitric acid in situ from nitrogen oxides that can react with moisture to form nitric acid, and preferably most advantageously, from nitric oxide NO, although nitrogen tetroxide ($N_2O_4$), nitrogen trioxide ($N_2O_3$), nitrogen dioxide ($NO_2$) and nitrate ions, nitric ions, nitronium ions, and nitrosonium ions are also suggested.

Nowhere however does Brink suggest a reaction with nitrogen dioxide, $NO_2$, and oxygen.

There is no teaching of a reaction between wood (or pulp) and $NO_2/O_2$; there is only a teaching of a reaction between wood (or pulp) and $HNO_3$.

When applied to lignocellulosic material, the Brink process involves a completely different set of reactions from an activation, applied to pulp. Brink's reactions with nitric acid also can involve different constituents of the lignocellulosic material (or pulp).

In addition to application to lignocellulosic material, under time and temperature conditions where represent pulping conditions, as a first stage, Brink also applies the process as a second stage, in treating the pulp product resulting from the first stage, using a lower temperature, and a higher moisture content of the lignocellulosic material; the reaction time is the same. Nonetheless, Brink does not disclose reaction of pulp with $NO_2$ and $O_2$. Neither does Brink disclose a combined activation by $NO_2$-$O_2$ followed by oxygen gas bleaching.

In accordance with Samuelson, U.S. Ser. No. 270,438, filed June 4, 1981, the activation stage is carried out with nitrogen dioxide gas in the presence of oxygen gas in an amount such that nitrogen monoxide formed as an intermediate is consumed, while regulating the amount of oxygen gas that is added in such a manner that at the conculsion of the activation stage practically all of the nigrogen monoxide and nitrogen dioxide have been consumed.

SUMMARY OF THE INVENTION

That invention accordingly provides a process for the treatment of cellulose pulp with nitrogen dioxide $NO_2$ adapted for application before an oxygen gas bleaching to make possible a more complete delignification and an improved oxygen gas bleaching, without deterioration in the paper-making properties of the pulp, which comprises subjecting the cellulose pulp to an activation reaction with nitrogen dioxide gas in the presence of water and pure oxygen gas in an amount within the range from about 0.1 to about 5 moles per mole of $NO_2$ and in an amount within the range from about 0.6 to about 5 moles per mole of NO, so that nitrogen monoxide formed in the activation is utilized in the activation reaction.

That invention also provides a process for the delignification of cellulose pulp, including chemical pulp prepared from the digestion of lignocellulosic material, which comprises bringing the cellulose pulp in an activation stage in the presence of water and in contact with a gas phase containing nitrogen dioxide and modifying the lignin of the cellulose pulp by reaction with nitrogen dioxide; adding oxygen gas to the activating reaction in an amount within the range from about 0.1 to about 5 moles per mole of $NO_2$ and in an amount within the range from about 0.5 to about 5 moles per mole of NO, so that the nitrogen monoxide formed in the activation is utilized in the activation reaction; and then in a second stage, subjecting the pulp to an oxygen gas bleaching in the presence of an alkaline-reacting neutralization medium or neutralizing agent.

In accordance with Samuelson, U.S. Ser. No. 330,406, filed Dec. 14, 1981, cellulose pulp produced by chemically pulping lignocellulosic material is contacted in an activating stage in the presence of water with a gas phase containing $NO_2$ and oxygen gas, which is supplied in order to utilize the intermediate product NO for activation; and thereafter the pulp is subject to an alkali treatment, both the activating stage and the alkali treatment stage being carried out under drastic conditions, at such high temperature during the activating stage as to obtain a certain degree of degradation of the cellulose molecule, and at a temperature during the alkali treatment process within the range from about 95° to about 150° C., suitably from 101° to 140° C., preferably from 110° to 120° C., the treatment time at 95° C. exceeding 45 minutes, at 101° C. exceeding 30 minutes, and at 110° C. exceeding 15 minutes.

This process has however the disadvantage that it requires a very high alkali charge, and results in a high loss of carbohydrates, if the two-stage process is carried far enough to achieve a low lignin content.

In accordance with Samuelson, U.S. Ser. No. 358,998 filed Mar. 17, 1982, residual lignin in cellulose pulp produced by chemically pulping lignocellulosic material is removed while maintaining good pulp quality by contacting the cellulose pulp in an activating stage in the presence of water with a gas phase containing $NO_2$ and oxygen gas at a temperature within the range from about 40° to about 100° C. sufficient to obtain a degradation of the cellulose molecules resulting in a reduction in the intrinsic viscosity of the cellulose pulp during the activation stage within the range from about 2 to about 35% compared to the intrinsic viscosity prior to the activation; and then subjecting the pulp to an oxygen gas-alkali-treatment at a temperature within the range from about 80° to about 150° C., at an oxygen partial pressure within the range from about 0.005 to about 0.18 MPa.

The change in the intrinsic viscosity of the cellulose pulp is used as a measurement of the extent to which the cellulose molecules have been degraded. The viscosity values given therein have all been determined without removing lignin and hemicellulose, which is the most reproducible method for pulps with a moderate lignin content (for example with sulfate pulps having a Kappa number below 35).

A partial pressure of 0.18 MPa with respect to oxygen gas during a major part of the oxygen gas-alkali-treatment affords rapid delignification and good selectivity, while delignification at 0.005 MPa takes place very slowly. At a partial pressure below 0.005 MPa, the bleaching is reduced, and the brightness of the pulp is impaired. The pulp acquires a greyish color, but pulp treated at a higher oxygen gas pressure becomes a pure yellow color. In addition, the pulp yield decreases at low oxygen pressure.

In accordance with Samuelson Ser. No. 361,289, filed Mar. 24, 1982, a process is provided for activating chemical cellulose pulp and then delignifying bleaching the activated pulp, which comprises treating chemical cellulose pulp in an activating stage with nitrogen oxides in the form of $NO_2$ and/or NO and/or polymer forms and double-molecules thereof, such as $N_2O_4$ and $N_2O_3$ with an oxygen-containing gas in the presence of nitric acid added in an amount within the range from about 0.1 to about 1.0, suitably from 0.15 to 0.80, and preferably from 0.25 to 0.60, g mole per kg of water accompanying the cellulose pulp at a temperature within the range from about 40° to about 120° C., suitably from 50° to 100° C., preferably from 55° to 90° C. for an activating time at an activating temperature of from 40° to 50° C. of from about 15 to about 180 minutes, at a temperature of from 50° to 90° C. of from about 5 to about 120 minutes, and at temperatures above 90° C. from 1 to about 10 minutes, followed by a washing and at least one delignifying stage in an aqueous alkaline medium, either in the presence or in the absence of oxygen gas and/or peroxide.

The combination of these nitrogen oxides and nitric acid provides an activating effect which results in a greatly improved delignification after the alkaline delignifying stage. The delignifying effect obtained in accordance with the invention with 2% $NO_2$ by weight of the dry pulp is approximately the same as that obtained with twice the amount of $NO_2$, if no nitric acid is added. This is surprising, since treatment of the pulp with nitric acid in a concentration within that stated range prior to the alkaline stage, without any addition of $NO_2$ and/or NO, has no appreciable effect on the delignification.

The activating effect is obtained irrespective of whether or not oxygen or peroxide is present in the alkaline delignifying stage.

It is surprising that when a suitable amount of nitric acid is present during the activating stage, depolymerization of the carbohydrates, primarily in cellulose, is slowed down in the alkaline delignifying stage when the alkaline medium constitutes an oxygen gas delignifying medium. Thus, under optimum conditions while there is a certain depolymerization (loss in viscosity) in the activating stage, a pulp is nonetheless obtained whose viscosity after the alkaline oxygen gas delignifying stage, not only when compared at the same lignin content (Kappa number) of the pump but also when compared at the same reaction time in the oxygen gas stage, is markedly higher than that of pulp similarly activated, but without nitric acid being added during the activating stage. Obviously, when an optimum amount of nitric acid is present, the activation provides a chemical reaction which greatly inhibits the degradation of cellulose in the subsequent alkaline oxygen gas bleaching stage.

Two-stage methods comprising pretreatment of pulp with nitrogen dioxide followed by oxygen gas bleaching with sodium hydroxide as the active alkali enable extensive delignification to be carried out, but chemical consumption, however, is high, and it is difficult to obtain simultaneously extensive delignification, paper of good strength properties from the pulp, and a high carbohydrate yield, without incurring high costs.

Rising energy prices have made necessary the replacing of present energy-consuming and environmentally-harmful chemical-pulp bleaching processes with a process which consumes less energy and which, in addition, enables all, or at least a major part, of the waste liquors deriving from the bleaching plant to be burned in conventional waste-liquor combustion processes. The oxygen gas bleaching of pulp directly after digestion, using sodium hydroxide as the active alkali, is a process now used in many sulphate plants. The process affords a reduction in the amount of chlorine and sodium hydroxide used in the bleaching stages, and enables recovery and combustion of about half of the total amount of dry solids released in the bleaching stages. When the oxygen gas bleaching process is more extensive, the carbohydrates are excessively depolymerized, resulting in a pulp having poorer paper qualities. An important recognized problem is how to effect more extensive delignification using smaller amounts of chlorine, sodium hydroxide and oxygen gas, while burning a larger percentage of the waste by products.

In accordance with Samuelson, U.S. Ser. No. 449,889 filed Dec. 16, 1982, now U.S. Pat. No. 4,445,969, patented a process is provided for delignifying bleaching lignin-containing cellulose pulp in three stages, an activating stage, in which there is supplied to the water-containing pulp NO and/or $NO_2$ and $O_2$, and optionally $HNO_3$; a first alkaline stage, in which alkali is supplied as carbonate, primarily $HC_3^-$, with oxygen gas; and a second alkaline stage in which alkali is supplied as carbonate, primarily $CO_3^{--}$, with oxygen gas.

The process comprises:

(1) activating cellulose pulp by reacting the pulp with a gas comprising $NO_2$ and oxygen and optionally nitric acid in the presence of water;

(2) washing the activated pulp with water or an aqueous solution;

(3) treating the activated washed pulp with an aqueous alkaline solution comprising an alkaline carbonate of which a major proportion is in the form of bicarbonate $HCO_3^-$ at a temperature within the range from about 90° to about 170° C., suitably from about 105° to about 160° C., preferably from about 115° to about 140° C., in the presence of oxygen gas at an average oxygen partial pressure within the range from 0.001 to about 0.2 MPa, until the lignin content of the pulp is so reduced that the Kappa number of the pulp is within the range from about 10 to about 60%, suitably within the range from about 20 to about 50%, preferably within the range from about 25 to about 40% of the Kappa number of the pulp entering the activating stage (1), and releasing carbon dioxide gas liberated;

(4) treating the activated washed pulp with an aqueous alkaline solution comprising an alkaline carbonate of which a major proportion is in the form of carbonate $CO_3^{--}$ at a temperature within the range from about 90° to about 170° C., suitably within the range from about 110° to about 150° C., preferably within the range from about 120° to about 140° C., in the presence of oxygen gas at an average oxygen partial pressure within the range from about 0.1 to about 3 MPa, suitably within the range from about 0.2 to about 1.8 MPa, preferably within the range from about 0.3 to about 1.0 MPa;

(5) withdrawing from stage (4) alkaline liquor comprising $HCO_3^-$ and recycling said liquor to stage (3) as a source of $HCO_3^-$.

In implementing the reaction of nitrogen oxide with lignocellulosic material a batch reactor has been used into which nitrogen oxide gas is charged either before, simultaneously with, or subsequent to the introduction of oxygen gas. The reactor is rotated so as to obtain good contact between the lignocellulosic material and the active components in the gas phase.

A system for the continuous treatment of lignocellulosic material has also been proposed in which the reactor has a conduit at the inlet end for the introduction of nitrogen oxide, and a conduit at the outlet end for the introduction of oxygen.

It will be noted that in both the batch and continuous systems, the total amounts of nitrogen oxide and oxygen are introduced into the same reactor.

When nitrogen oxide and oxygen are contacted with lignocellulosic material in the presence of water a number of complex chemical reactions take place. While the reactions with oxygen are important, it is not necessarily desirable that oxygen be present from the outset. This is because of the course taken by the reactions, which can be divided into at least two phases.

Initially, in the first phase, a reaction takes place between the nitrogen oxide and the lignocellulosic material, primarily the lignin, and also with water, to form, inter alia, nitric acid. In the subsequent second phase, nitrogen oxide is regenerated by oxygen and again reacts with the lignocellulosic material, primarily the lignin. It has now been found to be advantageous to conduct the first reaction phase in the absence of oxygen, or preferably in the presence only of a small quantity of oxygen. On the other hand, a considerable quantity of oxygen is necessary in the second reaction phase. The previously proposed apparatus systems are not so constructed as to permit pretreatment of the lignocellulosic material in two phases.

In accordance with the invention, apparatus is provided for reacting lignocellulosic material with a gas phase comprising a nitrogen oxide and oxygen under controlled gas pressure in the presence of water, for example, as a pretreatment before an alkaline delignification, comprising in combination:

(1) a first reaction chamber receiving water-containing lignocellulosic material, nitrogen oxide, and optionally oxygen containing gas;
(2) a first inlet for introducing lignocellulosic material into the first reaction chamber;
(3) a second inlet with control means for introducing nitrogen oxide into the first reaction chamber;
(4) a first outlet for withdrawing lignocellulosic material after reaction with nitrogen oxide from the first reaction chamber;
(5) gas locks retaining gas pressure in the first reaction chamber at the first inlet and first outlet;
(6) a second reaction chamber in connection with the first reaction chamber via the gas lock at the outlet thereof, and receiving lignocellulosic material after reaction with nitrogen oxide;
(7) a third inlet with control means for introducing oxygen into the second reaction chamber;
(8) a second outlet for withdrawing lignocellulosic material after reaction with oxygen from the second reaction chamber; and
(9) a gas lock retaining gas pressure in the second reaction chamber at the second outlet; the second reaction chamber having a volume that is at least 2.5 times and preferably at least 10 times the volume of the first reaction chamber.

As the nitrogen oxide there can be used nitric oxide, NO; nitrogen dioxide, $NO_2$; polymers and adducts thereof, such as $N_2O_4$ and $N_2O_3$; and mixtures of these chemicals. The nitrogen oxide is introduced either in gas or in liquid form. The oxygen is introduced in liquid form or in the form of an oxygen-containing gas, preferably pure oxygen. In either case, in each reaction chamber nitrogen oxide and oxygen are present in a gas phase, and are retained in the chambers by the gas lock provided at each reaction chamber. The reaction nitrogen oxide is usually $NO_2$, and the nitrogen oxide if not $NO_2$ is selected to form $NO_2$ in situ.

The specific design chosen for the apparatus is dependent upon which nitrogen oxide is supplied to the first reaction chamber. The inlet for supplying the nitrogen oxide is connected at any place along the first reaction chamber. Preferably the inlet is adjacent to the inlet for lignocellulosic material. When nitrogen dioxide is introduced, no oxygen gas supply is necessary. If $NO_2$ is to be formed in situ from nitrogen oxide of lower oxidation state, such as nitric oxide, an oxygen-gas inlet is also connected to the first reaction chamber, preferably at the outlet end. A particularly suitable arrangement provides an inlet for feed of oxygen gas phase from the second reaction chamber to some point along the first reaction chamber and to a point at the outlet end of the first reaction chamber. The amount of oxygen introduced in this case is at least that stoichiometrically required to convert the nitric oxide to nitrogen dioxide in situ.

The inlet for oxygen in the second reaction chamber can be connected anywhere but it is preferred to place it at the outlet end of the chamber, i.e. where the lignocellulosic material is discharged.

In accordance with another embodiment of the invention a third chamber is placed intermediate the first reaction chamber and the second reaction chamber. This intermediate chamber is provided with gas locks at the inlet and at the outlet. The intermediate chamber has at least one inlet for oxygen-gas supply conduit, and optionally a conduit for transferrng the gas phase therein to the first reaction chamber.

These inlets, outlets and conduits incorporate suitable flow regulating means, for example valves, so as to control accurately the amount of gas and/or liquid introduced or withdrawn.

According to a preferred embodiment of the invention, the first and second reaction chambers are in separate vessels, for example, towers, through which the lignocellulosic material flows by gravity or is pumped or fed by screw feeders. The reaction chambers may also include a plurality of separate reaction chambers or zones arranged in parallel or in series flow in the same vessel, for example, as zones in a reactor tower. The lignocellulosic material, especially cellulose pulp, can be advantageously finely divided while being introduced into the reaction chambers, or subsequently thereto. Suitably, the material is finely divided by means of a rotating fluffing device. However, it is not necessary to finely divide the cellulose pulp, since pulp in sheet form can be treated. The reaction chambers can be provided with mechanical means for agitating and/or transporting the material.

The gas lock can be any device through which the lignocellulosic material can be advanced to the next part of the system while, at the same time, gas is prevented from passing freely therethrough, even when there is a gas pressure differential between the inlet and outlet ends. A small quantity of gas present in the material itself or in the gas lock will normally accompany the material during its passage, but pressure within the reaction chamber is nonetheless controlled, because gas cannot flow freely between the reaction chambers, and between a reaction chamber and the ambient atmosphere. A small flow of gas through the gas lock in a direction opposite to that travelled by the material can be used internally of the apparatus, i.e., between the first and second reaction chambers, but is not suitable at a location where the material is fed into or out of the apparatus.

Examples of suitable gas locks include flow-blocking pumps, for example, high-consistency pumps or thick-pulp pumps; screw feeders; rotary presses, e.g. roller presses, or rotary vane feeders; rotatable cock-type feed valves; gas lock and feeding arrangements in which the material is fed in, preferably in a compressed state, by means of a piston. A scraper conveyor is another example.

The apparatus according to the invention incorporates gas locks at the inlet and outlet of the first reaction chamber, and at the inlet and outlet of the second reaction chamber. The gas lock at the outlet of the first reaction chamber serves also as the gas lock at the inlet of the second reaction chamber if there is a direct flow connection between them for transfer of lignocellulosic material; if not, separate gas locks may have to be provided at each chamber. While any kind of gas lock can be used at all locations in the apparatus, it is preferred in accordance with one embodiment of the invention that different types of gas locks be installed at the inlet and outlet of the first reaction chamber, and at the outlet of the second reaction chamber.

The gas lock at the inlet of the first reaction chamber advantageously is a screw-feeder, in which the screw and the screw housing are so designed that the lignocellulosic material is compressed as it is advanced. Conveniently, the screw-feeder is provided with means for carrying away water squeezed from the materials as it is compressed, and also any gas pressed from said material.

When the lignocellulosic material is cellulose pulp, the pulp will normally have a pulp concentration of less than 20% at the inlet of the screw-feeder. If the pulp has a higher concentration, a similar screw conveyor is conveniently connected up; although without means for carrying away the water squeezed from the pulp.

These two types of screw feeders, in which the pulp is converted into a compact plug, enable the amount of oxygen gas accompanying the pulp to be kept to a very low level. It has surprisingly been found that the presence of oxygen gas at the inlet end of the first reaction chamber has an inhibiting effect on certain useful reactions, inter alia, on the demethylation of the lignin, and hence the pulp at this end of the first reaction chamber should be kept free from oxygen gas to the greatest possible extent. Consequently, whatever the type of gas lock used, it is advantageous for the gas lock to incorporate several zones or sectors through which the lignocellulosic material is advanced, with at least one of these sectors connected with means for evacuating and carrying away oxygen gas squeezed out from the material.

Advantageously, the gas lock at the outlet end of the first reaction chamber comprises a screw conveyor without means for carrying any water squeezed from the material. Alternative arrangements include rotary vane feeders or rotary cock valves, which normally include four sector-like compartments. In a first position, one compartment is filled with lignocellulosic material, which, in the next step, for example, after rotating the device through 90°, is located in a sealing position, and in a third position is emptied, by causing the material to fall down into the regenerating chamber, for example. Rotary valve feeders of this kind are normally used for feeding chips into a continuous cellulose pulp digestor.

The gas lock at the outlet end of the second reaction chamber suitably includes a pump of some kind. According to a preferred embodiment of the invention, one or more liquid supply conduits, for example, water supply conduits, is or are connected to the outlet end of the second reaction chamber. When the liquid content of the suspension in the chamber has not previously been sufficiently high, for example, higher than 90%, water and/or spent liquod is supplied, for example, through the supply conduits. This results in the aqueous suspension, with its high liquid content, acting as a barrier to prevent any appreciable leakage of gas from the gas phase in the second reaction chamber, or to prevent air being drawn thereinto. One discharge conduit is connected to the outlet end of the second reaction chamber, and includes a pump. However, a pump is not necessary, since the material can also be carried away from the outlet by a bottom scraper arranged in the second reaction chamber, as in oxygen bleaching reactors. The material can also be discharged by gravity or blown out by releasing pressure in the second reaction.

For cooling the material immediately prior to, in conjunction with, or immediately subsequent to feeding the material from the second reaction chamber, the material fed in via the oxygen-supply inlet and/or the liquid-supply inlet can be cooled. Cooling can be effected also by withdrawing gas phase from the reaction chamber, cooling the gas in a cooler, and then returning the gas to a cooling zone or a separate cooling chamber. It is also possible to equip the outer casing of the outlet end of the second reaction chamber with cooling means, or to connect a cooling means to the outlet conduit.

After having been treated in the apparatus, the lignocellulosic material is normally washed using any washing apparatus, and then transferred to an alkaline delignifying stage. Although the delignifying chemical or chemicals may comprise solely alkali, it is preferred to supply oxygen gas in addition thereto. Other chemicals may also be introduced to the delignifying stage.

As previously mentioned, the addition of a nitrogen oxide and oxygen to lignocellulosic material in the presence of water results in the initiation of a plurality of complex reactions. These reactions can be divided into (1) rapid initial reactions between the nitrogen oxide and the lignin, which among other things lead to the demethylation of the lignin;
(2) the rapid formation of nitric acid by reaction with water, which takes place in competition with (1);
(3) the re-oxidation of reduced nitrogen oxide, for example, the oxidation of nitric oxide to nitrogen dioxide, with oxygen;
(4) the regeneration of consumed nitrogen oxide by secondary reactions between modified lignin, nitric acid and oxygen gas, which results in the formation of an active form of nitrogen oxide, which is used for the continued activation of the material;
(5) secondary oxidation with oxygen, probably of both modified lignin and of the nitrogen oxide.

It has been found that oxygen inhibits one or more of the rapid initial reactions (1) in a manner which is unknown. Because of this, the secondary reactions (4) and (5) also decrease. On the other hand, reactions (2), (3) and (5) are benefited by the presence of oxygen.

With the aid of the apparatus according to the invention, it is possible to suppress the undesirable reactions and to promote the desirable reactions, which results in a surprisingly selective delignification of the lignocellulosic material in the delignifying stage following the pretreatment or activation stage. The design of the apparatus according to the invention also permits the reaction chemicals supplied to be recovered in a most advantageous manner, from both an economical and environmental aspect. Since the reaction chemicals supplied are utilized to the maximum, the total amount of chemicals supplied can be kept at a very low level, while minimizing the emission of unreacted nitrous gases. This is beneficial to both the economy and the internal environment of the cellulose pulp mill.

BRIEF DESCRIPTION OF THE DRAWINGS

FIGS. 1 and 2 show, respectively, apparatus according to two preferred embodiments of the invention.

In FIG. 1, there is shown an array of apparatus suitable for activating, for example, cellulose pulp in the form of a suspension of low pulp concentration.

DESCRIPTION OF THE PREFERRED EMBODIMENTS

The pulp suspension is introduced into the gas lock 1, in this case a screw conveyor. The conveyor is of conventional type and includes a perforated, cylindrical shell, which houses a rotatable conical screw. As the pulp suspension is moved along the conveyor, water is squeezed out from the suspension, and passes out through the perforations in the shell, to collect in the bottom part of the apparatus. The water collected, and possibly some air, is passed through a conduit 2 to a water seal 3, for removal of the water through a conduit 4. Any air which is pressed out can be conducted away from the top of the water seal 3, through a conduit and a vacuum pump connected thereto. The water seal prevents air from returning to and collecting in the screw conveyor 1. As the pulp suspension is moved through the conveyor 1, the pulp consistency is increased from, for example, 5% to 30%. This results in the formation of a substantially gas-tight, annular plug of pulp at the outlet of the screw conveyor 1.

In the outlet of the conveyor there can be arranged a regulatable holding-up arrangement, which can be set so as to cause the advancing pulp to pass through a gap of regulatable width, before charging the pulp to the top of the first reaction chamber 5. Although not necessary, it is preferred that the pulp forced through said gap be allowed to pass by gravity through a fluffer of any known design, so that the pulp, in a fluffed state, is deposited on the top of a column of pulp in the reaction chamber 5. In this situation, the pulp comes into contact with nitrogen oxide, for example nitrogen dioxide, in concurrent flow supplied through the inlet conduit 6. During its passage through the chamber 5, the lignin and the water in the pulp react with the nitrogen dioxide to form inter alia nitric oxide and nitric acid.

The pulp falls by gravity into a second gas lock 7, which also has the form of a screw conveyor. The pulp is advanced through the conveyor while maintaining a substantially constant pulp concentration, so as to form a plup plug which is advanced along the screw conveyor. By means of, for example, the previously described arrangements at the outlet of the screw conveyor, the pulp is fed in a fluffed condition onto the top of the plup column in the second reaction chamber 8. Oxygen is introduced into chamber 8 through a conduit 9, in either liquid or gas form.

It has been found that in the reactions taking place in the reaction chamber 5, the nitrogen dioxide is reduced to nitric oxide, the proportion of which can reach one-third of the amount of nitrogen dioxide charged, and which at prevailing temperature and pressure is substantially inert. The temperature is normally below 110° C., and the pressure is normally at atmospheric pressure, but preferably below atmospheric. When the amount of nitric oxide formed in the chamber 5 is relatively low, substantially all gas will accompany the pulp, since it becomes incorporated in the pulp plug advanced through the screw conveyor 7. In addition to nitric oxide, nitric acid formed and absorbed by the plup is also fed therewith to the reaction chamber 8.

In the reaction chamber 8, when the input oxygen gas comes into contact with the nitric oxide and the pulp, the previously mentioned second reaction phase takes place. Thus, the aforedescribed reactions (1) and (2) mainly take place in the chamber 5, while the reactions (3), (4) and (5) mainly take place in the chamber 8.

If a large amount of nitric oxide is formed and collects near the bottom of the chamber 5, an advantage can be obtained by introducing a small amount of oxygen gas to the bottom of said chamber, so as to begin to utilize the benefits of the nitric oxide at this early stage. Any oxygen gas so supplied must be in such small quantities as to ensure that no substantial concentration of oxygen gas is obtained in the top of chamber 5, since oxygen gas during the course of the initial reaction with nitrogen dioxide, i.e. particularly in the top of the reactor, is highly deleterious. The requisite quantity of oxygen gas can be taken from the reactor 8, and passed to the chamber 5 through the conduits 10 and 11. Alternatively, fresh oxygen gas can be supplied through the conduit 11.

Instead of the screw conveyor 7, the gas lock can have the form of a rotary vane feeder or rotary cock. A rotary vane feeder has the double function feeding nitric oxide and the pulp together in one compartment or pocket thereof, from the chamber 5 to the chamber 8, and of transporting, as it returns during its rotary action, oxygen-containing gas from the chamber 8, this oxygen reacting with nitric oxide collected on the bottom of the chamber 5.

At the bottom of the second chamber 8, the pulp is thinned with water, for example. The water is introduced through conduits 12 and 13. By supplying so much water that the column of fluffed pulp on the bottom of the chamber 8 is converted into a liquid suspension, there is obtained an effective barrier against the gas present above the surface of the liquid. This means that only an extremely small amount of gas will accompany the pulp out of the chamber 8, through the conduit 14.

The pulp is fed out from the chamber 8 with the aid of a bottom scraper (not shown), the scraper being driven by means of a motor 15. The discharged pulp suspension is suitably fed to a cyclone, where the suspension is freed from its gas content. This withdrawn gas can be passed to a purifying and/or reaction vessel, prior to being released to the ambient air. Part of the air flow can be passed through a conduit to an analysing instrument. Conveniently, gas phase from the chamber 5 is also drawn to said analysing instrument.

When nitric oxide is supplied through the conduit 6 instead of nitrogen dioxide, it is necessary that oxygen in at least stoichiometric quantities be supplied to the first reaction chamber 5 through the same or a separate conduit.

By means of the illustrated apparatus set-up according to the invention, and particularly by adapting the volumes of the two chambers and the positioning of the conduits through which the reaction chemicals are introduced into the system, it is possible to permit the previously described chemical reactions to take place under optimal conditions with regard to the apparatus used. Moreover, good economy and good internal environmental conditions within the plant are also ensured.

FIG. 2 illustrates an arrangement of apparatus which is suitable for activating cellulose pulp in the form of a pulp suspension of medium or high consistency.

The cellulose pulp is introduced into a gas lock 16, which in this embodiment has the form of a screw conveyor. The cellulose pulp is formed into a substantially gas-tight plug, which is advanced to the outlet end of the screw conveyor. The plug is finely divided at the outlet end, and falls down by gravity into a first reaction chamber 17. Nitrogen dioxide is introduced to the top of the column of pulp formed in the chamber 17, through a conduit 18. Connected to the bottom of the chamber is a conduit 19, through which dilution liquid is fed to the pulp. The dilution liquid may comprise waste liquor obtained from the process and containing nitric acid. The thinned pulp suspension is passed by means of a further gas lock, which comprises a screw conveyor 20, and a conduit 21, connected to a thick-pulp pump 22. It is also possible to omit the screw conveyor 20 and connect the conduit 21 directly to the bottom of the chamber 17. The pulp suspension is then fed by means of the pump through a conduit 23, to the top of the second reaction chamber 24. The oxygen gas required for the second reaction phase is supplied through a conduit 25. The pulp is then passed to an apparatus 26, where the pulp is further diluted. This apparatus functions as a gas lock, or as a part of such lock. Thinning liquid, which may comprise diluted waste liquor obtained from the process, is supplied through a conduit 27. The pulp, in the form of a suspension of low concentration, is fed through a conduit 28 to a pump 29, by means of which the pulp is transported through a conduit 30 to one or more washing filters, for example.

When a large amount of nitric oxide has collected at the bottom of the initial reaction chamber 17, there is introduced a small, controlled quantity of oxygen-containing gas, this gas being taken from the top of chamber 24 and passed to the bottom of chamber 17 through a conduit 31. When nitric oxide is supplied to the chamber 17 instead of nitrogen dioxide, oxygen must be supplied to the chamber through another conduit. This additional conduit can be connected to the chamber 17 in the proximity of or in connection with the conduit 18. It may also be an advantage in this case to introduce a small quantity of oxygen near the bottom of the chamber 17, for example, through conduit 31, and/or an additional conduit. In such a case conduit 31 is not always necessary.

Having regard to the foregoing disclosure the following is claimed as the inventive and patentable embodiments thereof;

1. Apparatus for reacting lignocellulosic material with a gas phase comprising a nitrogen oxide and oxygen under controlled gas pressure in the presence of water, as a pretreatment before an alkaline delignification, the oxygen suppressing rapid initial reactions between nitrogen oxide and lignin leading to demethylation of the lignin, and indirectly leading to decreases in the regeneration of consumed nitrogen oxide by secondary reactions between modified lignin, nitric acid and oxygen gas resulting in the formation of an active form of nitrogen oxide; while promoting reactions between nitrogen oxide and water forming nitric acid; reoxidation of reduced nitrogen oxide; and the secondary oxidation with oxygen of modified lignin and nitrogen oxide, comprising, in combination, in continuous flow sequence;

(1) a supply of water-containing lignocellulosic material, a supply of nitrogen oxide, and a supply of oxygen containing gas;

(2) a first reaction chamber receiving a continuous flow of water-containing lignocellulosic material, and nitrogen oxide from the supply of water-containing lignocellulosic material and the supply of nitrogen oxide;

(3) a first inlet for introducing lignocellulosic material into the first reaction chamber;

(4) a second inlet with control means for introducing nitrogen oxide into the first reaction chamber;

(5) a first outlet for withdrawing a continuous flow of lignocellulosic material after reaction with nitrogen oxide from the first reaction chamber;

(6) gas locks retaining gas pressure in the first reaction chamber at each of the first inlet and first outlet;

(7) a second reaction chamber in connection with the first reaction chamber via the gas lock at the outlet thereof and receiving a continuous flow of lignocellulosic material from the first reaction chamber after reaction with nitrogen oxide;

(8) a third inlet with control means for introducing oxygen from the supply of oxygen containing gas into the second reaction chamber;

(9) a second outlet for withdrawing a continuous flow of lignocellulosic material after reaction with oxygen from the second reaction chamber; and

(10) a gas lock retaining gas pressure in the second reaction chamber at the second outlet; the second reaction chamber having a volume that is at least 2.5 times the volume that is at least 2.5 times the volume of the first reaction chamber.

2. Apparatus according to claim 1, in which the first reaction chamber has an inlet and control means for supplying oxygen to said chamber.

3. Apparatus according to claim 2, characterized in which the oxygen inlet is in connection with the second reaction for flow of oxygen containing gas therefrom to the first reaction chamber.

4. Apparatus according to claim 1 having downstream of the gas lock at the outlet end of the first reaction chamber an intermediate chamber having an inlet end and an outlet end, and having an inlet for supplying oxygen and a gas lock at the outlet end thereof.

5. Apparatus according to claim 1 in which the gas lock at the inlet of the first reaction chamber includes a screw conveyor compressing the lignocellulosic material into a substantially gas-tight plug.

6. Apparatus according to claim 1 having means in the first reaction chamber for introducing a thinning liquid for thinning pulp.

7. Apparatus according to claim 6, having as the gas lock located at the outlet of the first reaction chamber a screw conveyor and/or a thick pulp pump.

8. Apparatus according to claim 1, in which the outlet of the second reaction chamber comprises means for thinning the lignocellulosic material with a liquid, and means for discharging the thinned lignocellulosic material, these together constituting a gas lock.

9. Apparatus according to claim 1 comprising a cooling means connected to the outlet of the second reaction chamber for cooling material discharged therefrom.

* * * * *

UNITED STATES PATENT AND TRADEMARK OFFICE

CERTIFICATE OF CORRECTION

PATENT NO. : 4,762,591

DATED : August 9, 1988

INVENTOR(S) : Hans Olof Samuelson

It is certified that error appears in the above-identified patent and that said Letters Patent is hereby corrected as shown below:

Column 3, line 13, "conculsion" should be --conclusion-- line 14, "nigrogen" should be --nitrogen--.

Signed and Sealed this

Twenty-first Day of February, 1989

*Attest:*

DONALD J. QUIGG

*Attesting Officer*

*Commissioner of Patents and Trademarks*